US006180309B1

(12) United States Patent
Maty et al.

(10) Patent No.: US 6,180,309 B1
(45) Date of Patent: Jan. 30, 2001

(54) ORGANIC PHOTORECEPTOR WITH IMPROVED ADHESION BETWEEN COATED LAYERS

(75) Inventors: David J Maty, Ontario; Robert L Flanagan, Fairport, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/449,984

(22) Filed: Nov. 26, 1999

(51) Int. Cl.[7] ..... G03G 5/06

(52) U.S. Cl. ..... 430/130; 430/132; 430/133; 430/134; 427/536

(58) Field of Search ..... 430/127, 130, 430/132, 133, 134; 427/536

(56) References Cited

U.S. PATENT DOCUMENTS

| | | | |
|---|---|---|---|
| 3,121,006 | 2/1964 | Middleton et al. | 430/31 |
| 3,357,989 | 12/1967 | Byrne et al. | 430/78 |
| 3,442,781 | 5/1969 | Weinberger | 430/32 |
| 3,904,407 | 9/1975 | Regensburger et al. | 430/58.6 |
| 4,286,033 | 8/1981 | Neyhart et al. | 430/60 |
| 4,291,110 | 9/1981 | Lee | 430/60 |
| 4,338,387 | 7/1982 | Hewitt | 430/85 |
| 4,415,639 | 11/1983 | Horgan | 430/64 |
| 4,576,831 * | 3/1986 | Hosoi et al. | 427/536 |
| 4,588,666 | 5/1986 | Stolka et al. | 430/96 |
| 4,666,735 | 5/1987 | Hoover et al. | 427/43.1 |
| 4,855,203 | 8/1989 | Badesha et al. | 430/84 |
| 4,871,634 | 10/1989 | Limburg et al. | 430/54 |
| 5,514,507 | 5/1996 | Yagi et al. | 430/65 |
| 5,521,047 | 5/1996 | Yuh et al. | 430/132 |
| 5,635,327 | 6/1997 | Fukuda et al. | 430/132 |
| 5,709,974 | 1/1998 | Yuh et al. | 430/66 |
| 5,891,594 | 4/1999 | Yuh et al. | 430/134 |
| 5,915,514 | 6/1999 | Nojiri et al. | 192/38 |
| 6,045,962 * | 4/2000 | Kushbiki et al. | 430/132 |

FOREIGN PATENT DOCUMENTS

| | | | |
|---|---|---|---|
| 2108865 * | 5/1983 | (GB) | 427/536 |
| 59-56430 * | 3/1984 | (JP) | 427/536 |

* cited by examiner

*Primary Examiner*—Roland Martin
(74) *Attorney, Agent, or Firm*—Oliff & Berridge, PLC

(57) ABSTRACT

A process for preparing an imaging member includes applying a first organic layer to an imaging member substrate, treating the first organic layer with one of corona discharge or plasma discharge; and applying a second organic layer to the first organic layer.

16 Claims, No Drawings

ORGANIC PHOTORECEPTOR WITH IMPROVED ADHESION BETWEEN COATED LAYERS

BACKGROUND OF THE INVENTION

1. Field of Invention

The present invention relates in general to electrophotography and, in particular, to a process for preparing electrophotographic imaging members or photoreceptors. The present invention provides a process for forming such imaging members, and imaging members formed thereby, having improved adhesion between coated layers.

2. Description of Related Art

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing electron donor molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

Suitable coating methods used for applying the various layers in electrophotographic imaging members include dip coating, roll coating, Meyer bar coating, bead coating, curtain flow coating and vacuum deposition. Solution coating is a preferred approach because it is more economical than vacuum coating and can be used to deposit a seamless layer.

U.S. Pat. No. 4,855,203 to Miyaka teaches applying charge generating layers from coating solutions comprising a resin dispersed pigment. Miyaka discloses suitable organic solvents for preparing a coating solution of the pigments as including alcohols such as methanol, ethanol and isopropanol; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane and ethylene glycol monomethyl ether; esters such as methyl acetate and ethyl acetate; aliphatic halogen hydrocarbons such as chloroform, methylene chloride, dichloroethylene, carbon tetrachloride and trichloroethylene; or aromatic compounds such as benzene, toluene, xylene, ligroin, monochlorobenzene and dichlorobenzene.

U.S. Pat. No. 3,904,407 to Regensburger et al. teaches applying perylene containing charge generating layers by a vacuum coating process. Vacuum coated charge generating layers containing perylenes show a high photosensitivity. However, vacuum coating is expensive.

U.S. Pat. No. 5,521,047 to Yuh et al. is directed to a process for preparing an electrophotographic imaging member having a perylene-containing charge generating layer from solution. The process comprises forming a dispersion of a perylene pigment and a polyvinylbutyryl binder in an acetate solvent and applying the dispersion to an electrophotographic imaging member layer by solution coating. Yuh et al. teaches that perylenes form stable dispersions in acetate solvents for the purposes of application by solvent coating such as dip coating.

U.S. Pat. No. 5,891,594 to Yuh et al. discloses a process for preparing an electrophotographic imaging member having a perylene-containing charge generating layer. The process includes the steps of dispersing a perylene-containing charge generating material in a solvent comprising n-butylacetate and a second solvent having a lower boiling point than n-butylacetate, wherein the second solvent is an acetate or tetrahydrofuran, and applying the dispersion to form the charge generating layer on a substrate or underlayer of the imaging member.

Despite the presence of various methods for forming imaging member layers, it is desired in the art to increase the adhesion between successive layers in an imaging member package. In particular, in the case of endless (seamless) belts, which tend to undergo much mechanical stress, increased adhesion of the successive layers in the imaging member is particularly desired.

Various treatment methods are generally known in the art to improve adhesion between successive layers in a photoreceptor. For example, U.S. Pat. No. 5,915,514 discloses the use of plasma or corona discharge on an insulating member (substrate) of a donor roll, to increase adhesion and to provide a uniform subsequent metal coating. The disclosed process includes the step of applying corona discharge to the surface of the donor roll, prior to coating the donor roll substrate with a photo or thermally sensitive composition comprised of a polymeric material and a conductive metal nucleating agent.

Similarly, various methods such as plasma discharge and corona discharge are known and used for various purposes. For example, U.S. Pat. No. 5,635,327 discloses the use of glow discharge decomposition to apply amorphous silicon containing at least one of hydrogen and a halogen onto a conductive substrate. Likewise, U.S. Pat. No. 5,514,507 discloses using plasma discharge to form a layer having amorphous silicon germanium as a main body containing at least hydrogen, fluorine and a group III element.

SUMMARY OF THE INVENTION

The present invention is directed to a process for preparing an organic electrophotographic imaging member having at least a charge generating layer and a charge transport layer, wherein the imaging member has increased adhesion between at least two of the layers. The process comprises applying one of corona discharge or plasma discharge to the surface of an organic layer of the imaging member, and subsequently forming a coating layer thereover. The corona or plasma treatment provides increased adhesion between the respective layers.

In particular, the present invention provides a process for preparing an imaging member, comprising:

applying a first organic layer to an imaging member substrate, treating said first organic layer with one of corona discharge or plasma discharge; and applying a second organic layer to said first organic layer.

In other embodiments, the present invention provides imaging members formed by such a process.

DETAILED DESCRIPTION OF PREFERRED EMBODIMENTS

The present invention relates to a method for increasing the adhesion between adjoining layers of an imaging member, preferably an organic imaging member, by applying a corona or plasma discharge to the underlying layer. In the present invention, the described corona and/or plasma discharge may be applied to any of the various organic layers of the imaging member, which layer is subsequently coated with another layer. Such treatment provides increased adhesion between the two layers. Although the corona or plasma discharge may be applied to any or all of the various layers, it is preferred that the layer to be treated is an organic-based layer, i.e., a layer that includes, in whole or in part, organic molecules and/or an organic binder.

According to embodiments of the present invention, an electrophotographic imaging member is provided, which generally comprises at least a substrate layer, a charge generating layer, and a charge transport layer. This imaging member can be employed in an imaging process providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps.

In general, electrostatographic imaging members are well known in the art. An electrostatographic imaging member, including the electrostatographic imaging member of the present invention, may be prepared by any of the various suitable techniques, provided that at least one of the underlying organic layers is processed or treated by the corona discharge or plasma discharge methods of the present invention, which will be described below.

According to the present invention, at least one of the organic layers is treated by corona discharge or plasma discharge (including glow discharge) to roughen the surface of the layer. Such treatments roughen the layer surface, at least on a micro scale, to provide increased adhesion of the layer to a subsequently applied layer. In embodiments, such treatment can avoid the use of separate adhesive layers between respective layers of the photoreceptor. Although such treatment can be used on any of the underlying layers of the imaging member, the treatment is preferably applied to at least one of the organic layers. Preferably, the treatment step is conducted inline as a step in the production process, which permits fabrication of imaging members with increased adhesion.

Preferably, in embodiments of the present invention, the corona or plasma discharge treatment only roughens the surface of the particular layer. That is, the treatment preferably physically alters the desired layer, such as by forming valleys in the layer material, and does not itself apply a separate, distinct layer of material to the layer, such as by forming peaks of a different material on the layer.

According to the present invention, the specific parameters of the treatment step will generally depend upon, for example, the specific materials be treated and the amount of roughening that is desired. In embodiments of the present invention, the roughening is preferably not so rough as to be visible to the naked eye, although such treatment is within the scope of the present invention. Preferably, the surface roughening is visible under a magnification of 1,000×, more preferably under a magnification of 10,000×, using scanning electron microscopy. If the surface roughening is not visible under a magnification of about 100,000×, then further roughening treatment may be necessary.

One suitable treatment method is corona discharge. Corona discharge treatment is illustrated, for example, in U.S. Pat. No. 4,666,735 (in particular at col. 6), the entire disclosure of which is incorporated herein by reference. Corona discharge may be applied to the surface of the layer to be treated at any effective stage during the fabrication of the imaging member. For example, corona discharge may be applied to the desired layer surface immediately after the underlying layer is applied, immediately before the successive layer is applied, or in between the two. Any suitable equipment may be used to treat surfaces with corona discharge, including, but not limited to, Enercon Model A1 corona surface treater available from Enercon Industries Corporation.

According to the present invention, different parameters of the treatment may be necessary depending, for example, on the material being treated. Thus, the power setting, wattage, and the like of the equipment may be adjusted as desired. If necessary, scanning electron microscopy may be used to assess the degree of surface roughening.

An alternative to corona discharge is plasma discharge. Plasma discharge, which includes glow discharge, can be conducted on the layer surface in a similar manner to corona discharge. Preferably, however, the plasma or glow discharge is conducted in vacuum. Plasma discharge treatment is described, for example, in Vossen and Keen, *Thin Film Processes*, Acedemic Press Inc., pages 24–31 (1978) and Brian Chapman, *Glow Discharge Processes*, John Wiley and Sons, the entire disclosures of which are incorporated herein by reference. As with corona discharge, plasma discharge may be applied to the surface of the layer to be treated at any effective stage during the fabrication of the imaging member. For example, plasma discharge may be applied to the desired layer surface immediately after the underlying layer is applied, immediately before the successive layer is applied, or in between the two. Any suitable equipment may be used to treat surfaces with plasma discharge, including, but not limited to the PX Series of equipment available from March Instruments, Concord Calif.

As with corona discharge treatment, described above, according to the present invention, different parameters of the treatment may be necessary depending, for example, on the material being treated. Thus, the power setting, wattage, and the like of the equipment may be adjusted as desired. If necessary, scanning electron microscopy may be used to assess the degree of surface roughening.

If necessary and/or desired, the corona or plasma discharge treatments of the present invention can be performed with the imaging member substrate held next to a chill drum, or other suitable support. This may be particularly desired in instances where the substrate and/or individual layers may be susceptible to deformation during the corona or plasma discharge treatment.

The structure of an exemplary imaging member according to the claimed invention will now be described.

Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$ (gamma-aminobutyl)methyl diethoxysilane, $[H_2N(CH_2)_3]CH_3Si(OCH_3)_2$ (gamma-aminopropyl)methyl diethoxysilane, mixtures thereof, and the like, as disclosed in U.S. Pat. Nos. 4,291,110, 4,338,387, 4,286,033 and 4,291,110, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, but are not limited to, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

However, according to the present invention, such an optional adhesive layer can be omitted, particularly if the underlying blocking layer is corona discharge or plasma discharge treated, as described above. That is, where a blocking layer has been applied to a substrate, the blocking layer can be corona or plasma discharge treated so as to roughen the surface of the blocking layer. Such roughening of the surface of the blocking layer provides increased adhesion between the blocking layer and a subsequently applied layer.

Any suitable photogenerating layer may be applied to the adhesive or blocking layer, which in turn can then be overcoated with a contiguous hole (charge) transport layer as described hereinafter.

Again, as with the blocking layer described above, any of the organic layers applied subsequent to the substrate being provided can be roughened and the surface structure chemically modified near the surface only according to the processes of the present invention. Thus, for example, where a charge generating layer is applied followed by a charge transport layer, the charge generating layer can be corona or plasma discharge treated to roughen the surface thereof prior to application of the succeeding layer.

Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetatevinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Of course, thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member formed by the process of the present invention generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight binder, between about 27 percent and about 3 percent by weight charge transport material, and between about 64 percent and about 85 percent by weight solvent for dip coating applications. Drying of the deposited coating may be effected by any suitable conventional technique such as oven drying, infrared radiation drying, air drying and the like.

Generally, the thickness of the charge transport layer is between about 10 and about 50 micrometers, but thickness outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An optional overcoat layer may be applied over the charge transport layer. The overcoat layer may comprise, for example, a dihydroxy arylamine dissolved or molecularly dispersed in a polyamide matrix. The overcoat layer may be formed from a coating composition comprising an alcohol soluble film forming polyamide and a dihydroxy arylamine.

In these embodiments, any suitable alcohol soluble polyamide film forming binder capable of forming hydrogen bonds with the hydroxy functional materials may be utilized in the overcoating. The expression "hydrogen bonding" is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide utilized in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent, which also dissolves the hole transporting small molecule having multi hydroxy functional groups. The polyamides polymers required for the overcoatings are characterized by the presence of amide groups, —CONH. Typical polyamides include the various Elvamide resins, which are nylon multipolymer resins, such as alcohol soluble Elvamide and Elvamide TH Resins. Elvamide resins are available from E. I. Dupont Nemours and Company. Other examples of polyamides include Elvamide 8061, Elvamide 8064, and Elvamide 8023. One class of alcohol soluble polyamide polymer is disclosed in U.S. Pat. No. 5,709,974, the entire disclosure of which is incorporated herein by reference.

The polyamide should also be soluble in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd., and other N-methoxymethylated polyamides, such as those prepared according to the method described in Sorenson and Campbell "Preparative Methods of Polymer Chemistry" second edition, pg 76, John Wiley & Sons Inc. 1968, and the like, and mixtures thereof. Other polyamides are Elvamides from E. I. Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, and the sensitivity of the overcoated photoreceptor. To overcome this, the overcoating of this invention also includes a dihydroxy arylamine, as disclosed in U.S. Pat. Nos. 5,709,974, 4,871,634 and 4,588, 666, the entire disclosures of which are incorporated herein by reference.

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

The photoreceptors of the present invention may comprise, for example, a charge generator layer sandwiched between a conductive surface and a charge transport layer, as described above, or a charge transport layer sandwiched between a conductive surface and a charge generator layer. This structure may be imaged in the conventional xerographic manner, which usually includes charging, optical exposure and development.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques may be utilize to form and develop electrostatic latent images on the imaging member of this invention. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

An example is set forth hereinbelow and is illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example 1

An electrophotographic imaging member is prepared. The imaging member includes a nickel substrate, a blocking layer, a charge generating layer, and a charge transport layer. The blocking layer is coated using a solution of Luckamide (a polyamide film forming polymer available from Dai Nippon Ink) in a mixture of methanol, butanol and water. The blocking layer is applied at a thickness of 1.0 micrometer, and is dried at 145° C. for 10 minutes. The charge generating layer is coated using a solution of benzimidazole perylene in B79 (a polyvinylbutyral available from Monsanto Chemical Co.) in cyclohexanone. The charge generating layer is dried at 106° C. for 10 minutes. The charge transporting layer is coated using a solution of a mixture of PCZ400 (a polycarbonate) and mTBD (N,N'-diphenyl-N,N'-bis[3-methylpropyl]-[1,1'-biphenyl]-4,4'-diamine) in monochlorobenzene. The charge transporting layer is dried at 118° C. for 45 minutes.

Each of the blocking layer, the charge generating layer, and the charge transport layer are applied in sequence. However, prior to applying the charge generating layer, the blocking layer is subjected to corona discharge to roughen the surface.

Following completion of the imaging member, the interfacial adhesion between the blocking layer and the charge generating layer is determined. This design provides a high adhesion between the blocking layer and the charge generating layer.

Example 2

An electrophotographic imaging member is prepared according to the procedures of Example 1, except that plasma discharge is used instead of corona discharge to roughen the surface of the blocking layer. Following completion of the imaging member, the interfacial adhesion between the blocking layer and the charge generating layer is determined. This design provides a high adhesion between the blocking layer and the charge generating layer.

Comparative Example 1

An electrophotographic imaging member is prepared according to the procedures of Example 1, except that no surface roughening treatment is used on the blocking layer. Following completion of the imaging member, the interfacial adhesion between the blocking layer and the charge generating layer is determined. This design provides adhesion between the blocking layer and the charge generating layer that is reduced as compared to the designs of Examples 1 and 2, above.

Accordingly, these results show that the processes of the present invention provide increased adhesion between the layers of the photoreceptor.

What is claimed is:

1. A process for preparing an imaging member, comprising:

applying a first organic layer to an imaging member substrate, treating said first organic layer with one of corona discharge or plasma discharge; and applying a second organic layer to said first organic layer, wherein at least one of said first organic layer and said second organic layer is one of a charge generating layer and a charge transporting layer.

2. The method of claim 1, wherein said first organic layer is a blocking layer.

3. The method of claim 2, wherein said second organic layer is one of a charge generating layer and a charge transporting layer.

4. The method of claim 1, wherein said first organic layer is one of a charge generating layer and a charge transporting layer.

5. The method of claim 4, wherein said second organic layer is different from said first organic layer and is one of a charge generating layer, a charge transporting layer, and an overcoating layer.

6. The method of claim 1, wherein said treating step roughens a surface of the first organic layer.

7. The method of claim 6, wherein said roughening is visibly apparent on said surface of said first organic layer.

8. The method of claim 6, wherein said roughening is not visibly apparent on said surface of said first organic layer.

9. The method of claim 8, wherein said roughening is apparent on said surface of said first organic layer only under a magnification of at least 1,000×.

10. The method of claim 8, wherein said roughening is apparent on said surface of said first organic layer only under a magnification of at least 10,000×.

11. The method of claim 6, wherein said roughening is apparent on said surface of said first organic layer under a magnification of 100,000× or less.

12. The method of claim 1, wherein said treating step provides increased adhesion between the first organic layer and the second organic layer.

13. The method of claim 1, further comprising:

treating said second organic layer with one of corona discharge or plasma discharge; and applying a third organic layer to said second organic layer.

14. The method of claim 1, wherein said treating step does not apply a separate material to a surface of said first organic layer.

15. An imaging member made by the process of claim 1.

16. The imaging member of claim 15, wherein said first organic layer has a rough surface.

* * * * *